United States Patent [19]

Booker

[11] Patent Number: 4,510,237

[45] Date of Patent: Apr. 9, 1985

[54] IN SITU FILM HARDENING WITH ALDEHYDE BISULFITE AND NONHARDENING ALDEHYDE

[75] Inventor: Reginald A. Booker, New Castle, Del.

[73] Assignee: E. I. Du Pont de Nemours and Company, Wilmington, Del.

[21] Appl. No.: 540,776

[22] Filed: Oct. 11, 1983

[51] Int. Cl.[3] ..... G03C 1/30

[52] U.S. Cl. ..... 430/621; 430/523; 260/117

[58] Field of Search ..... 430/621, 607, 523; 260/117

[56] References Cited

U.S. PATENT DOCUMENTS

| | | | |
|---|---|---|---|
| 2,165,241 | 7/1939 | Sheppard | 430/621 |
| 2,591,542 | 4/1952 | Harriman | 430/621 |
| 3,232,761 | 2/1966 | Allen et al. | 430/621 |

*Primary Examiner*—Won H. Louie

[57] ABSTRACT

A hardened photographic film is formed as a result of in situ generation of hardener by incorporating an aldehyde bisulfite in one layer and a nonhardening aldehyde in an adjacent layer. Preferred aldehyde bisulfite is glutaraldehyde bisulfite and preferred nonhardening aldehyde is orthosulfobenzaldehyde.

5 Claims, No Drawings

IN SITU FILM HARDENING WITH ALDEHYDE BISULFITE AND NONHARDENING ALDEHYDE

BACKGROUND OF THE INVENTION

1. Field of the Invention

The present invention relates to hardening gelatin layers in photographic silver halide films.

2. Description of the Prior Art

Photographic films are commonly formed by coating two or more layers on a support. The layers comprise a wide range of aqueous dispersions of both light sensitive and auxiliary compositions. Many films comprise two layers wherein a silver halide emulsion is coated on the support and is then overcoated with a protective or antiabrasion layer.

A wide variety of agents are known for hardening gelatin layers in photographic silver halide films, e.g., Chrome alum, formaldehyde, glutaraldehyde, glyoxal, and 1,3,5-triacryloylhexahydro-S-triazine. Abele et al, U.S. Pat. No. 4,124,397, describes a process in which glutaraldehyde and its derivatives are injected into a photographic emulsion to avoid adverse effects on sensitivity and premature hardening; while Le Strange U.S. Pat. No. 4,175,970, describes sensitization of a silver halide emulsion with a combination of glutaraldehyde and an aromatic sulfonic acid.

Glutaraldehyde is known to crosslink gelatin as much as 3600 times as fast as formaldehyde. Because of this rapid hardening action glutaraldehyde serves an important role as a hardener in developers. When it is used in a developer the sensitization and premature hardening problems associated with incorporation of glutaraldehyde in a sensitive silver halide emulsion do not occur.

It would be a significant advance to be able to employ a hardener such as glutaraldehyde directly within a silver halide emulsion and obtain rapid hardening without the drawbacks of special equipment and procedures.

SUMMARY OF THE INVENTION

Hardening of a photographic film according to the present invention involves incorporation of an aldehyde bisulfite in one coating composition and a nonhardening aldehyde in another composition which will be coated adjacently. The coated layers produce the aldehyde via component diffusion. An in situ exchange reaction is believed to occur wherein the aldehyde bisulfite is converted to an aldehyde. The in situ produced aldehyde reacts with the gelatin to harden the film.

In one embodiment one reactant is incorporated in the silver halide emulsion layer and the other in an adjacent layer.

A preferred system for the practice of the present invention contains 0.001 to 0.1 mole of orthosulfobenzaldehyde in one layer and 0.001 to 0.1 mole of glutaraldehyde bisulfite (1,5-dihydroxypentane-1,7 disulphonic acid disodium salt) in another layer per 100 g of gelatin.

DETAILED DESCRIPTION OF THE INVENTION

The following four bisulfite addition products represent aldehyde bisulfites suitable for the practice of the present invention. Of these, number 4 represents a preferred compound since it is believed to produce glutaraldehyde via an in situ reaction with a nonhardening aldehyde.

| Structure | Name |
|---|---|
| 1. $(HOH_2C)_2C(CHOH)_2$ <br> $\quad\quad\quad

The following equation represents a typical exchange reaction according to the present invention.

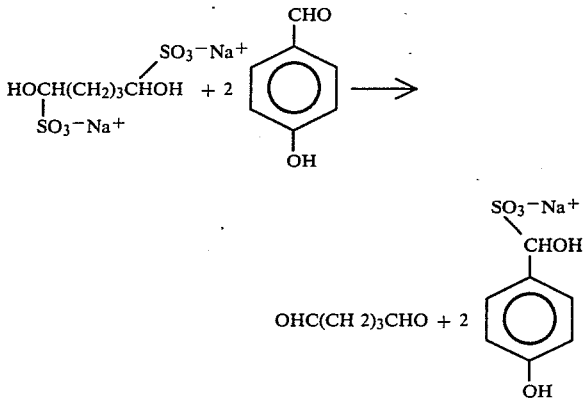

It should be obvious that 1 mole of an aldehyde bisulfite of the formula

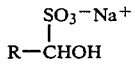

will react with 1 mole of nonhardening aldehyde to yield the aldehyde; while 1 mole of an aldehyde precursor of the formula

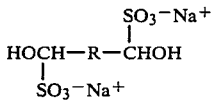

will react with 2 moles of nonhardening aldehyde to yield the aldehyde. Thus, any large imbalance of additions in the two layers would serve no useful purpose because the excess could not react to produce hardener in the film.

Useful amounts of either the aldehyde bisulfite or the nonhardening aldehyde are between 0.001 and 1.0 mole per 100 g of gelatin in the layer to which they are added. Preferred amounts range from 0.001 to 0.1 mole of reactant per 100 g of gelatin in the layer for obtaining the degree of hardening usually required by commercial films.

Compounds of the present invention can be added to a wide range of coated layers to in situ harden an aldehyde crosslinkable protective colloid or binder. These include not only emulsion and antiabrasion layers but also underlayers, anticurl backings, release layers and mottle layers. In a three-layer coating it would be possible to put one reactant in the middle composition and distribute the other reactant in both the top and bottom layer. In a multiple layer coating the compounds could be alternated from layer to layer to provide maximum diffusion and reaction throughout the coated film.

The following examples serve to illustrate the present invention.

EXAMPLE 1

A silver iodobromide emulsion was prepared and gold and sulfur-sensitized according to known techniques in the art. After final additions were made the emulsion was divided for coating as a control without further additions and for experimental coatings per the present invention.

A gelatin solution was prepared for overcoating the emulsion. This was also split into portions. One portion which served as a control received an addition of 0.185 mole of formaldehyde per 100 g of gelatin in the overcoat composition.

For the control film the emulsion with no addition was coated on a polyethyleneterephthalate support and overcoated with the control overcoat containing formaldehyde.

Based on 100 g of gelatin in the emulsion the following additions of orthosulfobenzaldehyde were made to two portions of emulsion: Emulsion 1, 0.007 mole and emulsion 2, 0.01 mole.

To portions of overcoat containing 100 g of gelatin the following additions of glutaraldehyde bisulfite were made: Overcoat 1, 0.004 mole and overcoat 2, 0.006 mole.

Each emulsion was then overcoated with its corresponding overcoat to provide films demonstrating the in situ hardening according to the present invention.

After drying, the films were cut into samples for sensitometric and physical tests to determine hardening.

Melting points were determined by marking film strips with a black mark made with coater permanent brand marker and placing the strips in a 10% sodium hydroxide solution and raising the solution temperature until the black mark was observed to disappear. Wet gouge susceptibilities were determined by placing an increasing weight load on a sapphire stylus point as it is drawn across a film immersed in developer. A melting point below 35° C. and a wet gouge force of 0 incidate that the gelatin has not been hardened. The maximum reading for the wet gouge force was 124 grams.

Table 1 contains comparative data obtained after the films had aged for 24 hours.

TABLE 1

| FILM | MELTING POINT | WET GOUGE FORCE |
|---|---|---|
| Control | 47° C. | 11.8 |
| 1 | 80° C. | 22.2 |
| 2 | 80° C. | 23.0 |

These results clearly show substantially faster hardening in the two experimental films.

EXAMPLE 2

The reactions of glutaldehyde bisulfite with nonhardening aldehydes were studied in a 6% gelatin solution at 35° C. using viscosity measurements. These reactions showed the dramatic effect on viscosity of the aqueous gelatin similar to a control containing formaldehyde which effectively gelled the solution within about three hours of adding the formaldehyde. The correlation with the hardening effect of formaldehyde was predictable from a study of solution viscosity.

Table 2 contains results obtained from solution viscosity tests made with a vacuum jacketed pipette of a formaldehyde ($CH_2O$) control containing 0.02 mole; compound 4, 0.02 mole with 0.04 mole of compound 5, 6 or 8; compound 4, 0.03 mole with 0.1 mole compound 7.

TABLE 2

| | DRAIN TIMES IN SECONDS | | | |
|---|---|---|---|---|
| COMPOSITION | INITIAL | 1 HR | 3.5 HR | 5 HR. |
| Control | 106 | 116 | Gelled | |
| 4 + 5 | 44 | 53 | 27 | Gelled |
| 4 + 6 | Gelled within 15 minutes | | | |

TABLE 2-continued

| COMPOSITION | DRAIN TIMES IN SECONDS | | | |
|---|---|---|---|---|
| | INITIAL | 1 HR | 3.5 HR | 5 HR. |
| 4 + 7 | 50 | 54 | 82 | 123 |
| 4 + 8 | | Gelled immediately | | |

These results confirm the significantly faster hardening of the 4 plus 8 combination illustrated in a photographic film in Example 1.

EXAMPLE 3

The reactions of orthosulfobenzaldehyde with aldehyde bisulfite compounds were studied as in Example 2 using 0.04 mole of aldehyde with 0.02 mole of bisulfite. Table 3 contains results obtained in comparison with a gelatin solution with no addition.

TABLE 3

| COMPOSITION | DRAIN TIMES IN SECONDS | | | |
|---|---|---|---|---|
| | INITIAL | 1.25 HRS | 5 HRS | 7 HRS. |
| Control Gelatin | 40 | — | 39 | 39 |
| 1 + 8 | 22 | 28 | — | 35 |
| 2 + 8 | 21 | 22 | 24 | 27 |
| 3 + 8 | 29 | 40 | 74 | 87 |

These results show significant increase in viscosity for the combinations indicating hardening action, whereas the gelatin control was unchanged.

I claim:

1. A process of forming a hardened photographic film in wich a layer comprised of silver halide dispersed in gelatin is coated on a support in contact with another layer and dried, characterized in that an aldehyde hardening agent is formed in situ by reacting an aldehyde bisulfite in one layer and a nonhardening aldehyde in an adjacent layer.

2. The process of claim 1 where the aldehyde bisulfite is -1,3-Dihydroxy-2,2-dihydroxymethyl-propane-1,3-disulphonic acid disodium salt, 1,4-Dihydroxymethyl-1,4(1',1''-disulphonic acid disodium salt) cyclohexane, 2,2,6,6-Tetrahydroxy-methyl-1,7-dihydroxy-heptane-1,7-disulphonic acid disodium salt or 1,5-Dihydroxy-pentane-1,7-disulphonic acid disodium salt.

3. The process of claim 1 where the nonhardening aldehyde is 4-Hydroxybenzaldehyde, 4-Nitrobenzaldehyde, Piperonal or Ortho-Sulfobenzaldehyde.

4. The process of claim 1 which comprises incorporating glutaraldehyde bisulfite in one layer and orthosulfobenzaldehyde in another layer.

5. The process of claim 1 wherein one of the reactant compounds is incorporated into the layer containing silver halide.

* * * * *